US005183083A

United States Patent [19]

Debaes

[11] Patent Number: 5,183,083

[45] Date of Patent: Feb. 2, 1993

[54] GRIPPER GUIDE FOR DOUBLE-GRIPPER WEAVING MACHINES

[75] Inventor: John Debaes, Wenduine, Belgium

[73] Assignee: N.V. Michel Van de Wiele, Kortrijk-Marke, Belgium

[21] Appl. No.: 782,648

[22] Filed: Oct. 25, 1991

[30] Foreign Application Priority Data

Oct. 26, 1990 [BE] Belgium ..... 09001026

[51] Int. Cl.[5] ..... D03D 47/18

[52] U.S. Cl. ..... 139/449; 139/446

[58] Field of Search ..... 139/449, 446

[56] References Cited

U.S. PATENT DOCUMENTS

| | | | |
|---|---|---|---|
| 3,487,859 | 1/1970 | Piccoli | 139/446 |
| 4,188,980 | 2/1980 | Muller | 139/449 X |
| 4,807,671 | 2/1989 | Kerner | 139/449 |
| 5,033516 | 7/1991 | Debaes | 139/449 |

FOREIGN PATENT DOCUMENTS

| | | |
|---|---|---|
| 0312031 | 4/1989 | European Pat. Off. . |
| 1555432 | 1/1969 | France . |
| 2620740 | 3/1989 | France . |
| 2004925 | 1/1979 | United Kingdom . |
| 2200657 | 5/1990 | United Kingdom . |

*Primary Examiner*—Andrew M. Falik
*Attorney, Agent, or Firm*—James Creighton Wray

[57] ABSTRACT

Gripper guide for double-gripper weaving machines, comprising two bearing arms (5) and (5') running above one another and adjustable individually in the warp direction. An L-shaped guide strip (7), (7') is fixed to each bearing arm (5), (5') so that it is adjustable in height. In front of each guide strip (7), (7') there is a straight guide strip (8), (8') which forms a U-shaped channel for the gripper bars (4), (4') together with each of the first mentioned guide strip (7), (7'), so that the gripper bars do not swing. The straight guide strips (8), (8') are adjustable both in the warp direction and in height and are easily and quickly removable from their guide position, for example, through a hinged connection to the respective bearing arms (5), (5'), which permits the upper guide strip (8) to flap up and the lower guide strip to flap down. At the level of the drive gear wheels (2), (2') on the guide strips (8) and (8') at least one roller (20), (20') is disposed on a vertical shaft (21) in order to guide the gripper bars (4), (4').

18 Claims, 7 Drawing Sheets

GRIPPER GUIDE FOR DOUBLE-GRIPPER WEAVING MACHINES

BACKGROUND OF THE INVENTION

The present invention relates to the device for guiding the gripper bars of a double-gripper weaving machine. In the case of such weaving machines provision is made along both sides of the shed formed between the warp threads for a device for driving and a device for guiding two gripper bars lying one above the other. A gripper is situated on the end of each gripper bar.

By driving the gripper bars — which are situated and move in pairs in line with each other along both sides of the weaving machine — to and fro, the grippers lying in line with each other are taken for each pick simultaneously along both sides of the fabric into the open shed, a weft thread being taken along by one of the grippers and in the shed passed on to the other gripper at the place where the two grippers meet, following which both grippers are pulled back out of the shed, so that the weft thread in the end is pulled from one side of the fabric to the other side, through the shed. This cycle is repeated each time a shed is formed, a weft thread being taken in each case from one side of the fabric to the other and woven with the warp threads. The drive of the gripper bars is preferably carried out by means of drive gear wheels which mesh with toothed sides of said gripper bars.

Guide means also have to be provided for each gripper bar, so that the grippers cover the desired path during their to and fro movement. A known guide device is described in Belgian Pat. No. 8,701,166.

This gripper guide comprises, on the one hand, a number of rollers which are situated at the level of the drive gear wheel with their cylindrical surface against the gripper bars, in such a way that the gripper bars move between the rollers and their respective drive gear wheel. These rollers guide the gripper bars in such a way that they interact well with the drive gear wheel. This known gripper guide also comprises two guides contoured in an L-shape, each of which is provided to guide one of the gripper bars which in this case, being provided with a slipper on their ends, glide to and fro in the angle formed by their L-shaped guide, while the horizontal part of the guides is situated below the gripper bars.

The known gripper guide also comprises two guide tables which are provided to guide the gripper bar heads. These tables are fixed so that they are adjustable in height, weft direction and warp direction.

The above-mentioned parts of this gripper guide are each interconnected adjustably to form one unit, while the unit is adjustably connected to the frame of the weaving machine. The guides are each accommodated so that they are adjustable in height in a channel section which is fixed to the gripper guide housing. The gripper guide housing can rotate relative to the drive shaft.

A disadvantage of this gripper guide lies in the fact that, due to the L-shaped guides, the gripper bars are guided only along the bottom side and the rear side, as a result of which they swing forward on their to and fro movement. The result of this is that the roller guide operates operates jerkily, causing uneven wear to occur on the back of the gripper bars. The backs of the gripper bars become uneven, so that the guide rollers absorb increasingly strong impact forces. The bearings of the guide rollers are consequently subjected to great wear, so that these bearings in the end become defective after quite a short period of operation.

Another disadvantage of this gripper guide is that the play between the drive gear wheels and the corresponding gripper bars is difficult to set. For, the L-shaped guides are only (jointly) rotatable relative to the gripper guide housing, in addition to their common adjustability in height. This gives rise to another disadvantage, namely that individual setting of the gripper guide for each gripper bar separately is not possible.

SUMMARY OF THE INVENTION

The object of the invention is to provide a device for guiding the gripper bars of a double-gripper weaving machine which eliminates the above-mentioned disadvantages.

A subject of the invention is a gripper guide for double-gripper weaving machines, with a bearing housing in which drive gear wheels are disposed, and two horizontal bearing arms running above one another, each fixed so as to be adjustable in the warp direction, while at the front side of each of said bearing arms a guide strip with essentially L-shaped cross-section is fixed so that it is adjustable in height. This L-shaped guide strip is disposed in such a way that one of the angle-forming faces is fixed upright against a bearing arm, while the other angle-forming face extends forward from the bottom side of the upright face. These L-shaped guide strips end at one side where the drive gear wheels project from the bearing housing and at the other side where the bearing arms end. Along the edge of the bearing housing, past the projecting drive gear wheels and in line with each L-shaped guide strip, a short L-shaped guide piece which is adjustable in height and in the warp direction is fixed to a fixed part of the machine.

The gripper guide according to the invention also has a straight guide strip, disposed at a short distance before each L-shaped guide strip and parallel thereto at the same height, so that each L-shaped guide strip and the guide strip running before it form a U-shaped guide channel. Both straight guide strips are each individually fixed to their respective bearing arm with a connection which permits easy and rapid removal of the straight guide strips to free the U-shaped channel along the front side.

Each guide strip — or its connection devices to a carrier arm — is also provided with one or more adjusting screws by which the distance between the respective L-shaped guide strips and the straight guide strip fixed before them can be adjusted individually.

The gripper guide according to the invention can also be equipped with means for guiding the gripper bars even closer to the fabric edge. These means are in this case adjustable in warp direction, in weft direction and in height.

The gripper guide according to the invention also has in the straight guide strip at least one dry lubricating device which can lubricate the gripper bar during its sliding to and fro movement.

In another preferred embodiment of the invention, the straight guide strip has at the level of the gripper drive wheel a lower-lying part, on which one or more rollers are fixed on a vertical shaft, in such a way that they can guide the gripper bar with their cylindrical surface while they are rotating.

The gripper bars are moved to and fro by the gripper gear wheels, so that they slide in the U-shaped guide channels situated above one another. In this case the bearing arms are individually adjustable in the warp direction, and the L-shaped guide pieces are also adjustable individually in height. The straight guide strips are also adjustable individually in the warp direction relative to the L-shaped guide strips.

An advantage of the invention lies in the fact that the gripper bars are now also guided along the front side, which prevents swing of the gripper bars and limits the wear on various parts.

Another advantage of the invention lies in the fact that both the height of the guide and the play between gripper bar and drive gear wheel can be set for each gripper bar.

Another subject of the invention is a double-gripper weaving machine equipped with a gripper guide according to the invention.

Further advantages of the gripper guide according to the invention and of the weaving machine provided with such a gripper guide will emerge from the following detailed description of a preferred embodiment of such a gripper guide, without the invention being thereby limited to said possible embodiment.

This description is illustrated with reference to the appended figures, in which:

DETAILED DESCRIPTION OF THE DRAWINGS

A preferred embodiment of a gripper guide according to the invention is shown in perspective by means of FIGS. 1, 2, 6 and 7, a rear view, a front view, and two side views respectively.

Figure 1:
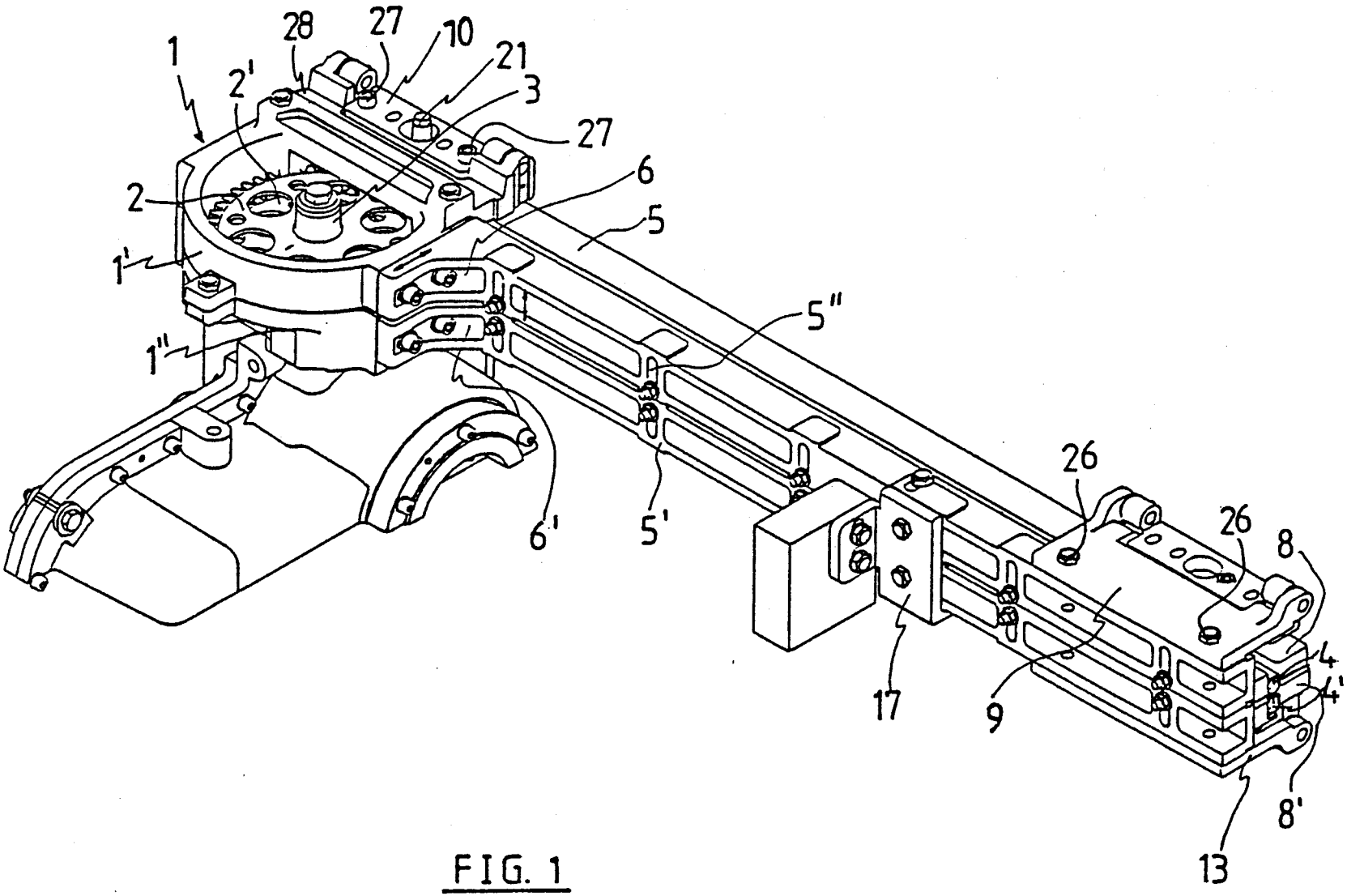
FIG. 1 shows in perspective a gripper guide according to the invention, viewed along the rear side.

The gripper guide is in each case shown with the drive unit to which it is attached. Situated along each side of the weaving machine is such a gripper guide with drive device extending in the weft direction towards the center of the weaving machine, the arrangement along one side being such that it is the mirror image of the arrangement along the other side, relative to the centre of the weaving machine. The arrangement of FIGS. 1 and 2 is suitable for placing on the left side of the machine, at the level of the shed (viewed from the fabric side), while the arrangement of FIGS. 6 and 7 is suitable for placing on the right side.

Figure 2:
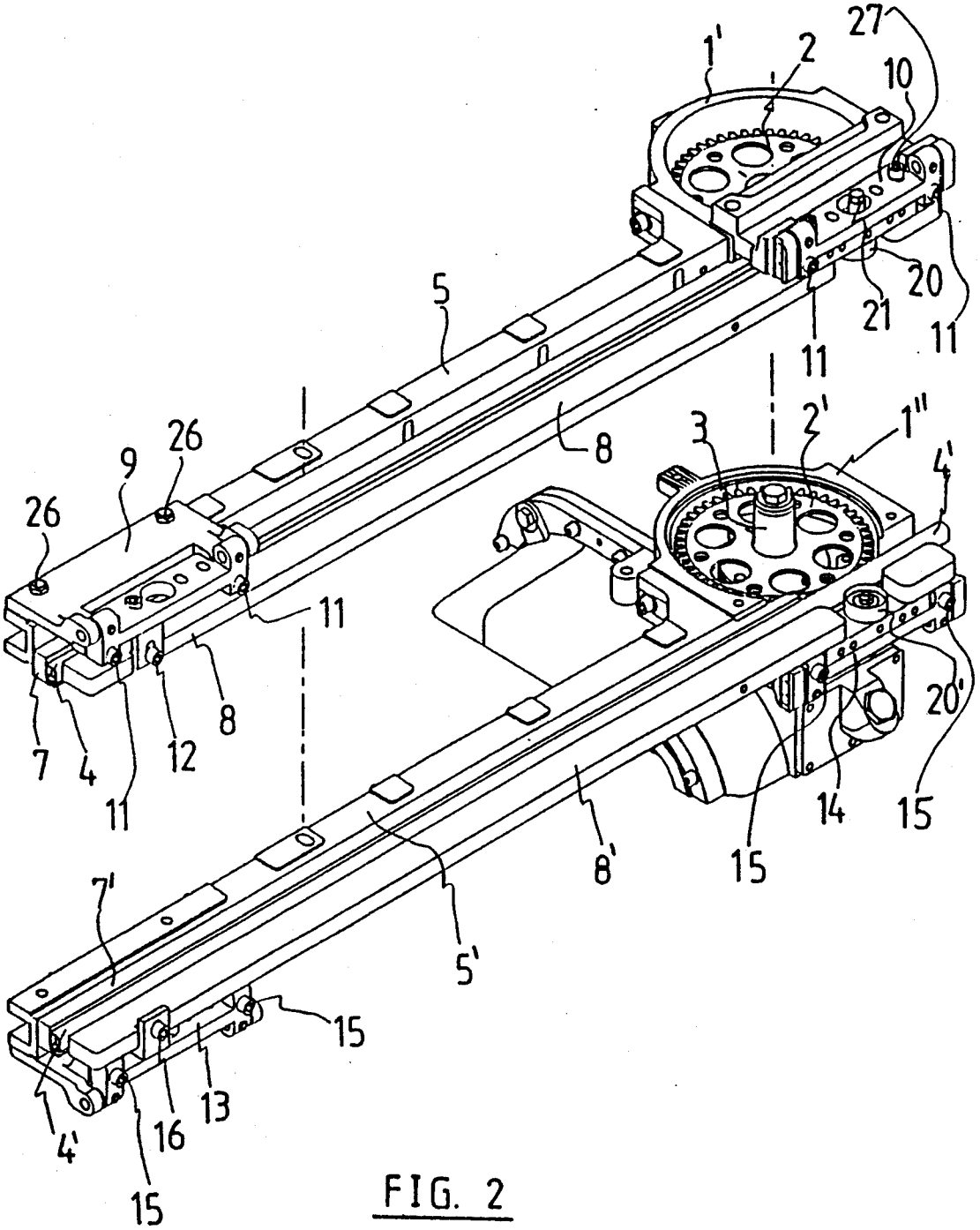
FIG. 2 shows in perspective a gripper guide according to the invention, viewed along the front side, in which the two component parts, for the upper and the lower gripper respectively, are moved apart along a certain distance in the vertical direction.
Figure 3A:
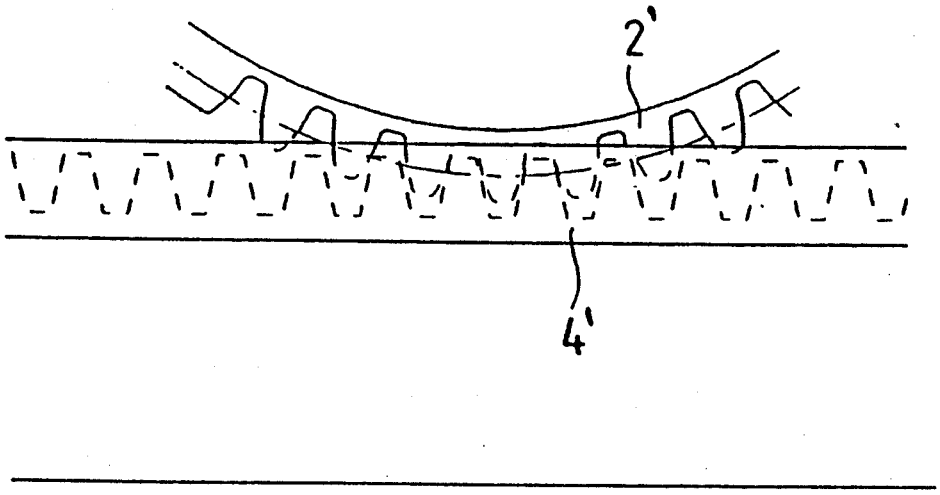
FIGS. 3*a* and 3*b* show a top view of the gripper guide according to the invention, at the level of the drive gear wheel, according to the two preferred embodiments.
Figure 3B:
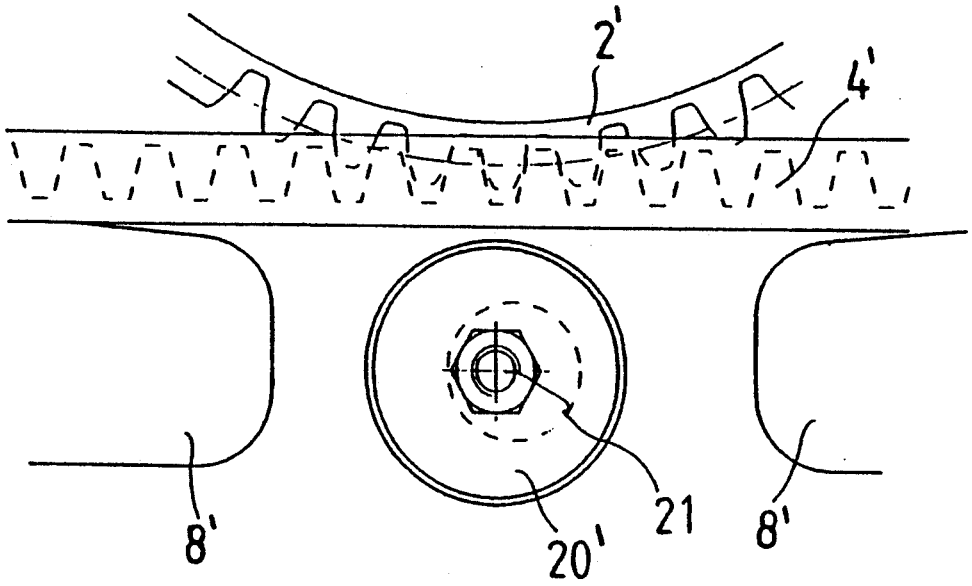
Figure 6:
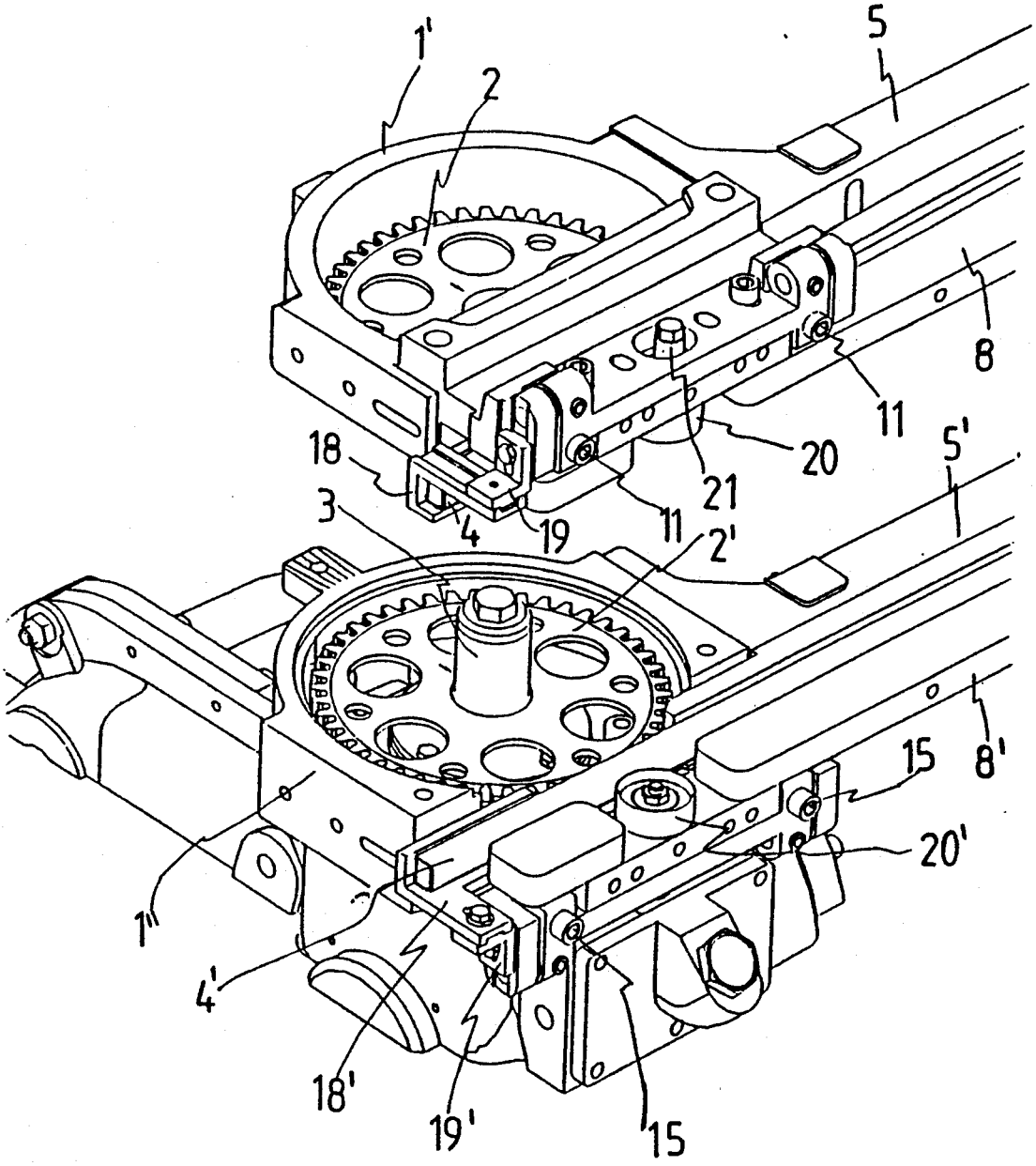
FIG. 6 shows in perspective a gripper guide according to the invention, viewed from the side where the drive gear wheels are situated, the upper and lower component parts being moved apart along a certain distance in the vertical direction.
Figure 7:
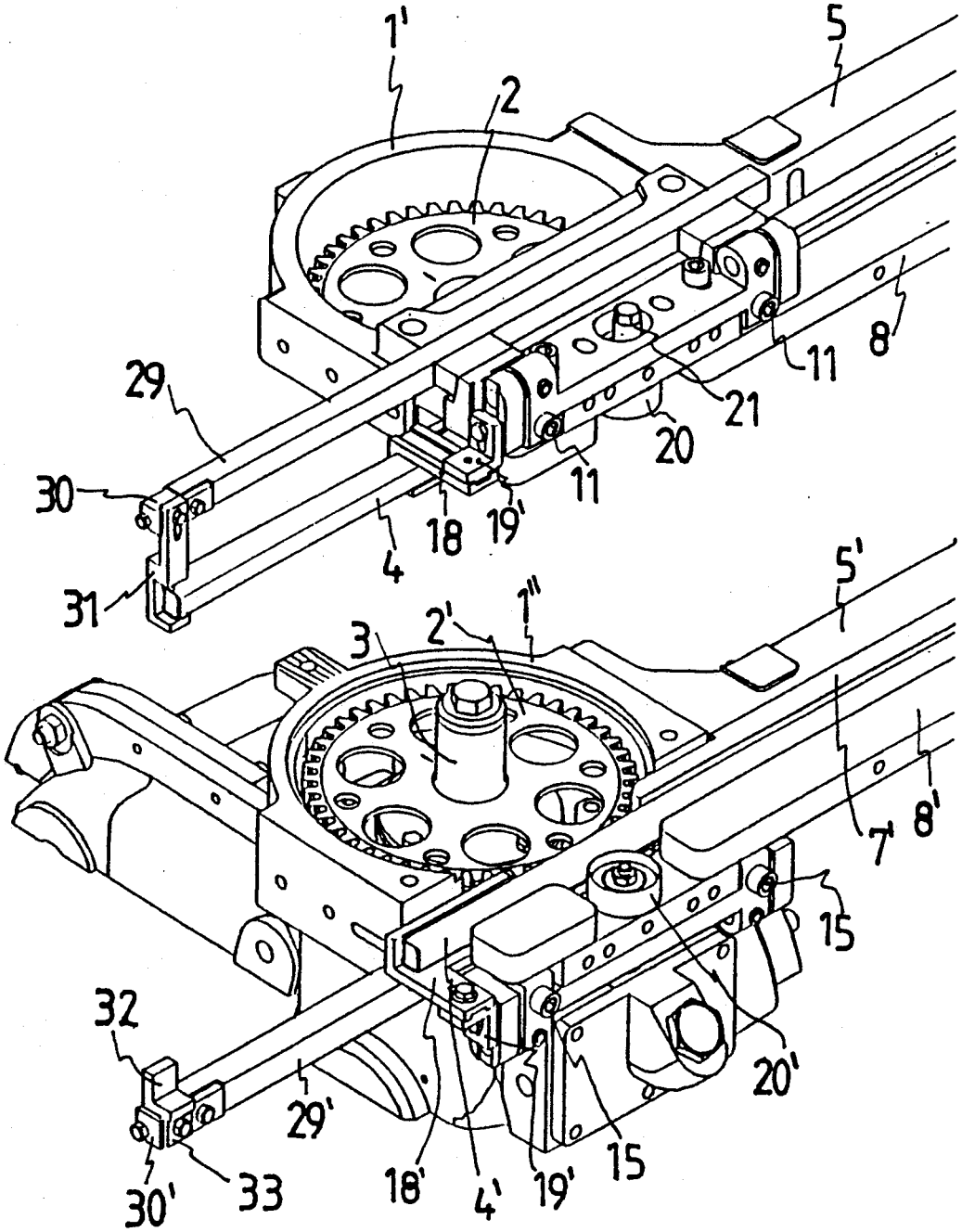
FIG. 7 shows in perspective a gripper guide according to the invention, viewed from the side as in FIG. 6, provided with additional adjustable guide means, for guiding the gripper bars even closer to the fabric edge.

Since both the gripper guide according to the invention and the parts of the drive unit fixed thereto handle the guidance thereof or interact with two identical gripper bars, the gripper guide and the drive unit attached thereto are each composed of two parts which are attached to each other and are composed of the same components, each part handling the drive and guidance of one of the gripper bars (see FIGS. 2, 6 and 7). If the weaving machine is viewed from the fabric side (the front side), a housing (1) is situated at the level of the place where the shed is formed, said housing being semicylindrical in shape, with the flat side facing forward, and in which two drive gear wheels (2) and (2') are disposed on a shaft (3) one above the other. The housing (1) is composed of two identical parts (1') and (1'') which are fixed on each other, and each of which contains a drive gear wheel (2) and (2').

These drive gear wheels (2) and (2') project along the flat side partially out of the housing (1), in order to allow each of them to drive one of the two gripper bars (4), (4') which are guided along said flat side of the housing (1).

The sides of the gripper bars (4) and (4') facing the drive gear wheels (2), (2') are provided with teeth for meshing with the drive gear wheels (2) and (2') over the distance needed to move the grippers situated on the ends of the gripper bars (4) and (4') into and out of the shed.

An identical horizontal bearing arm (5) and (5') extending laterally in the weft direction towards the outside is fixed on the side wall of each part (1') and (1'') of the housing (1) facing the outside of the weaving machine.

The bearing arm (5) is in this case situated on top of the bearing arm (5'), and both bearing arms run together over the same length.

Each bearing arm (5) and (5') is fixed individually to the wall of part (1') and (1'') of the housing (1). The end of each bearing arm widens out for this purpose and is provided with an elongated aperture (6) and (6') extending in the warp direction (see FIG. 1).

Two screws are screwed through each aperture (6), (6') into a hole in the wall of the part (1'), (1'') respectively of the housing (1). Due to the fact that these screws sit through an elongated aperture (6), (6') in the bearing arm (5) and (5'), said bearing arms (5) and (5') are individually adjustable in the warp direction.

An L-shape contoured guide strip (7) and (7') (FIG. 2 and FIG. 4) is now fixed at the front side of each bearing arm (5) and (5'), with the horizontal part along the bottom side. Said guide strip (7) and (7') with L-shaped cross-section lies with the vertical part against the front side of the bearing arm (5) and (5') respectively and thus runs together therewith along the entire length, along the side of the housing (1), ending just before the place where the drive gear wheel (2), (2') projects from the housing (1) to drive the gripper bar (4), (4'). The L-shaped guide strips (7) and (7') are fixed to the bearing arms (5) and (5') respectively in such a way that said strips are individually adjustable in height, through the fact that vertical apertures (5'') are provided in said bearing arms (5) and (5'), through which apertures the fixing screws project when screwed into the respective L-shaped guide strips (7) and (7'). Each L-shaped guide strip (7) and (7') is fixed in this way with several screws, which are distributed over the length of the guide strip (7) and (7').

Figure 4:
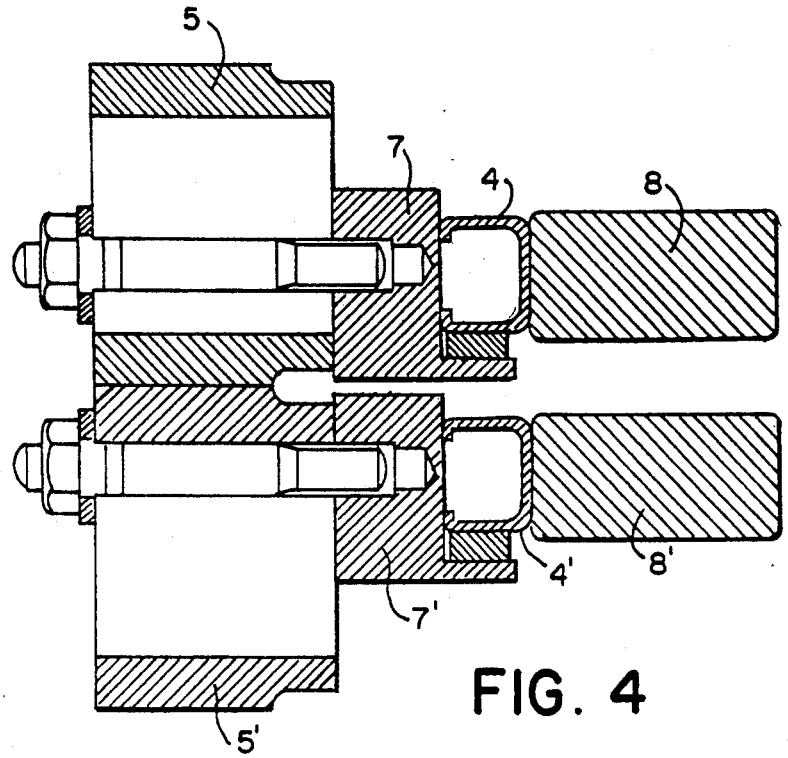
FIG. 4 shows a perpendicular cross-section of the gripper guide according to the invention, at a place where no lubricating device is provided.

Situated along the front side of each of the two L-shaped guide strips (7) and (7') is a straight guide strip (8) and (8'), parallel to and at the same height as the respective guide strips (7) and (7'), and at a distance in front of the upright flank of said L-shaped guide strips which — apart from a slight play — corresponds to the width of the gripper bars (4) and (4') (see FIG. 4). Through each L-shaped guide strip (7) and (7'), combined with the straight guide strip (8) and (8'), a U-shaped guide channel is obtained in this way for the gripper bars (4) and (4'). The straight guide strips (8) and (8') are hingedly fixed as follows relative to the bearing arms (5) and (5').

Fixed at the top side of the upper bearing arm (5) at one side — on the one end — is the fixed part of a hinge (9), the hinged part of which is fixed to the front flank of the top straight guide strip (8). At the other side — on the other end — the fixed part of a hinge (10) is fixed to the housing (1), extending above the top U-shaped guide channel, while the hinged part of said hinge (10) is fixed to the straight guide strip (8). Each of said hinges (9) and (10) is also equipped with at least one buffer block or similar part which is integral with the fixed part, and against which the hinged parts knock when the straight guide strip (8) is situated opposite the L-shaped guide strip (7), ready for guiding the upper gripper bar (4). The correct position of the straight guide strip (8) is determined in this way. For each hinge (9) and (10) the hinged part can be fixed by means of screws (11) to the buffer block or similar component of the fixed part.

The fixing of the hinge (9) to the front flank of the straight guide strip (8) is by means of a screw (12). The guide strip (8) can be flapped up after loosening of the screws (11). The fixing of the fixed part of the hinge (9) is by means of two screws (26) sitting through elongated apertures in said hinge (9). Said apertures extend in the warp direction, so that with the screws (26) the guide strip (8) can be set at the level of the hinge (9) closer to or further away from the L-shaped guide strip (7).

At the level of the bearing housing (1) the straight guide strip (8) is adjustable in the warp direction by means of two screws (27) which sit through elongated apertures extending in the warp direction through hinge (10). The setting in height can take place by the insertion of plates between the hinge (10) and the guide strip (8) fixed thereto.

Fixed at the bottom side of the lower bearing arm (5') are two hinges (13) and (14), the hinged parts of which are fixed to the straight guide strip (8'). The place and the manner of fixing are the same as the place and manner of fixing of the upper straight guide strip (8) relative to the upper bearing arm (5), as described above.

The hinges (13) and (14) are now, however, fixed to the bottom side of the bearing arm (5'), so that the guide strip (8') can now be flapped downwards. In the raised position the straight guide strip (8') lies directly opposite the L-shaped guide strip (7'), while the hinged part comes to rest against a buffer block or similar component of the fixed part, to which it can be fixed with screws (15).

The fixing of the hinged part of the hinge (13) to the front flank of the straight guide strip (8') takes place by means of a screw (16) with which the straight guide strip (8') can be adjusted in height, as described above for guide strip (8) with screw (12).

The adjustment in the warp direction of the guide strip (8') at the level of hinge (13) also takes place by means of two screws (26) (not visible in the figures) which sit through elongated apertures extending in the warp direction through the hinge (13).

At the level of hinge (14) the adjustment in the warp direction and in height of the guide strip (8') can take place in the same way as that of guide strip (8) at the level of hinge (10), with screws (27) (not visible) and through the interposition of plates respectively.

Along the rear side of the bearing arm (5) and (5') (see FIG. 1) a short L-shaped supporting section (17) is fixed to the frame of the weaving machine. The horizontal part of said supporting section (17) is at the correct height for supporting the lower bearing arm (5'). Said supporting section (17) is fixed to the weaving machine in a manner which is adjustable in height, by providing the fixing flank of said supporting section (17) with an aperture extending in the vertical direction, through which the fixing screws project and are screwed into the frame of the machine.

The preferred embodiment of the gripper guide according to the invention is also equipped with a short section (18) and (18') (see FIG. 6) with L-shaped cross-section in line with each L-shaped guide piece (7) and (7') fixed to the housing (1) or another fixed part of the weaving machine. Said sections (18) and (18') are provided for guiding the gripper bars (4), (4'), past the place where the drive gear wheels (2), (2') project from the housing (1). Their fixing to the housing (1) or another fixed part (see FIG. 6) is such that the arrangement can be altered both in height and in the warp direction. For this, each section (18) and (18') has a horizontal arm which is provided with an elongated aperture, extending in the warp direction, for fixing with a screw, bolt and nut, or similar means. Through this elongated aperture, each section (18) and (18') is adjustable in the warp direction. Both sections (18) and (18') are fixed to an L-shaped fixing piece (19), (19') respectively which are adjustable in height, one leg of the fixing piece (19) and (19') being fixed against the horizontal arm of the section (18), (18') respectively, while the other angle-forming leg is fixed to a fixed part of the weaving machine by means of a screw, a bolt and nut, or similar connecting device which sits through an elongated vertically extending aperture of the fixing piece (19), (19') respectively, as a result of which said fixing pieces (19) and (19'), and consequently also the sections (18), (18') respectively fixed thereto, are adjustable in height.

The preferred embodiment of the gripper guide according to the invention is also characterised in that a roller (20) and (20') is disposed on the top side of each straight guide strip (8) and (8'), at the same width for both guide strips (8) and (8'), at the level of the drive gear wheels (2), (2') respectively. These rollers (20) and (20') are situated on a vertical shaft (21) and are disposed in such a way that with their cylindrical surface they can guide the gripper bars (4), (4') respectively which slide to and fro behind the straight guide strips (8) and (8').

Figure 5:
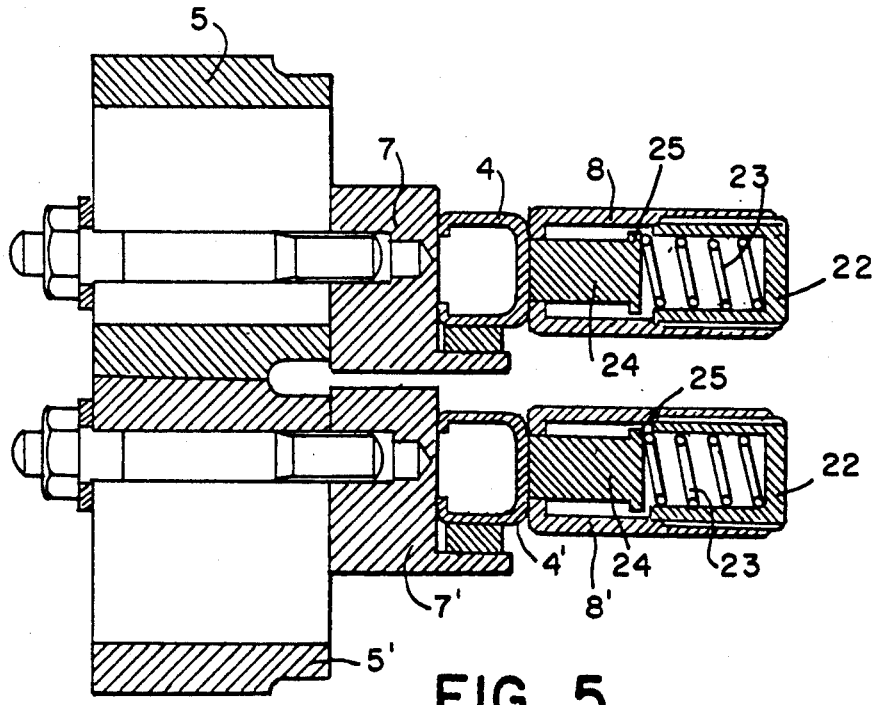
FIG. 5 shows a perpendicular cross-section of the gripper guide according to the invention, at a place where a preferred lubricating device is provided.

Each guide strip (8) and (8') preferably also contains a dry lubricating device, shown in a preferred embodiment in FIG. 5. Each guide strip (8) and (8') there is crossed locally in the horizontal direction by a hollow space or bore.

Along the front side said aperture in the wall of each guide strip (8), (8') can be shut off by means of a cover, screw cap or similar means (22). Resting against the inside of said screw cap (22) is a spring (23), whose other side presses against a teflon stick (24). The end of said teflon stick (24), or the part which is fixed on said end, against which the spring (23) presses, is provided with a widened part (25). The other end of the teflon stick (24) projects out through the aperture in the wall of the guide strip (8) or (8') and presses against the gripper bars (4), (4') respectively.

The widened part (25) is of such dimensions relative to the aperture through which the stick (24) projects that it is impossible for the teflon stick (24) to come completely out of the guide strip (8) or (8'). The screw cap (22) or cover can be screwed as desired further or less far into the internal screw thread which is provided in the hollow space or bore through the guide strip (8), (8'), so that the spring (23) exerts more or less pressure on the teflon stick (24) which is pressed against the front flank of the gripper bar (4) or (4').

The vertical flanks of the straight guide strips (8) and (8') along the edge of the gripper bars (4), (4') are provided with an anti-friction surface coating.

The housing (1) of the drive gear wheels (2) and (2') is also provided with means for fixing a suspension bar to which then — corresponding to Belgian Pat. No. 8,701,166 — adjustable guide means are fixed, for guiding the gripper bars (4) and (4') even closer to the fabric edge.

In a preferred embodiment of these additional guide means, the housing (1) of the drive gear wheels (2), (2') is provided (see FIG. 1) with a horizontally extending U-shaped recess (28) along the top side of the upper part (1') of the housing (1), and with an identical recess (not visible in the figures) along the bottom side of the lower part (1'') of the housing (1). A suspension bar (29), (29') extending further than the housing (1) in the direction of the fabric, in the weft direction, is fixed in these second slits (28). These suspension bars (29), (29') each have a part (30), (30') which can slide out in line with them in the direction of the fabric, and which can be adjusted at any desired extended length and fixed by means of a clamping screw or similar device.

A guide piece (31) extending vertically downward is fixed on the end of the telescopic part (30) of the upper suspension bar (29). Said guide piece (31) has a lower part which is essentially C-shaped, the open side being situated along the front side. The space enclosed by the C-shaped part has a cross-section which, apart from a certain play, corresponds to the cross-section of the gripper bar (4), in such a way that said gripper bar (4), extending from the gripper guide, can extend through said space enclosed by the C-shaped part, resting on the lower horizontal internal face of said C-shaped part. The gripper bar (4) is consequently guided by the guide piece (31) along the bottom side, the top side and the rear side.

Figure 8:
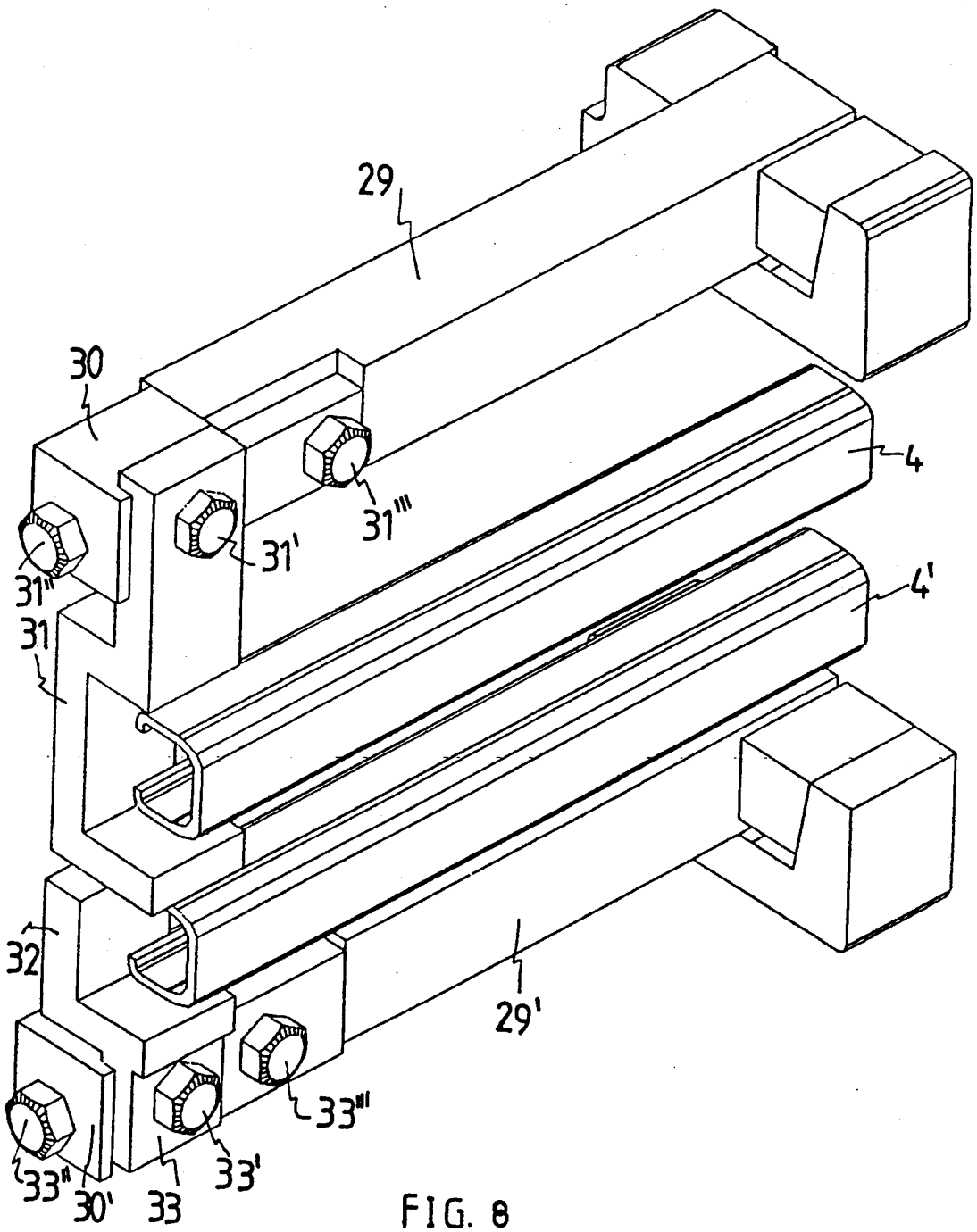
FIG. 8 shows in detail in perspective the additional adjustable guide means for guiding the gripper bars even closer to the fabric edge.

Said guide piece (31) is fixed so that it is adjustable in height — by means of a screw (31') sitting through an elongated aperture extending vertically — to the part (30) of the suspension bar (29). Due to the fact that the part (30) is telescopic, the guide piece (31) is also adjustable in the weft direction. In addition, the guide piece (31) is adjustable in the warp direction. For this, a micrometer screw (31'') is provided (see FIG. 8), by means of which a displacement in the warp direction of the part (30), and thus of the guide piece (31), relative to the suspension bar (29) can be obtained. Before this adjustment is carried out, a screw (31'') must be loosened After the correct adjustment, said screw (31'') is tightened again.

An L-shaped guide piece (32) is fixed on the end of the telescopic part (30') of the lower suspension bar (29'), with the one angle-forming part parallel to the horizontal top face of the telescopic part (30'), and with the other angle-forming part, at right angles thereto — on the rear edge thereof — directed upwards, the upright part extending parallel to the lengthwise direction of the suspension bar (29').

The dimensions of said L-shaped guide piece (32) are such that it can guide the lower gripper bar (4') along the bottom and along the back. For the fixing of this L-shaped guide piece (32) to the part (30') of the suspension bar (29'), this L-shaped guide piece (32) has along the bottom side of the horizontal part a vertically downward directed plate (33) which abuts the front flank of the part (30') of the suspension bar (29'). This plate (33) is provided with an upward extending, elongated hole for a screw (33'), which is tightened in the front flank of the part (30') of the suspension bar (29'), as a result of which the L-shaped guide piece (32) is fixed so that it is adjustable in height. Due to the fact that the part (30') is telescopic, the L-shaped guide piece (32) is also adjustable in the weft direction.

The guide piece (32) is also adjustable in the warp direction. For this, a micrometer screw (33''') is provided (see FIG. 8), by means of which a displacement in the warp direction of the part (30), and thus of the guide piece (32), relative to the suspension bar (29') can be obtained. Before this adjustment is carried out, a screw (33'') must be loosened. After the correct adjustment, said screw (33'') is tightened again.

An advantage of the invention is in the first place that swing of the gripper bars is prevented through the provision of a guide strip (8), (8') along the front side of each gripper bar (4), (4'). The wear on the gripper bars (4), (4') and the guide rollers (20), (20') and their bearing is thereby considerably limited, so that replacement of one or more of these parts is needed less frequently. This wear is even more limited through the fact that the gripper bars (4) and (4') are constantly lubricated with a dry lubricating device — preferably a teflon stick (24) — and through the fact that the guide strips (8) and (8') are provided with an anti-friction surface coating.

An additional consequence of this advantage is that it is now possible to weave at a higher weaving speed.

Another advantage of the invention lies in the fact that it is easier to adjust the play between drive gear wheels (2), (2') and gripper bars (4), (4').

Yet another advantage of the invention is that it is possible to carry out both the adjustments in the warp direction and the adjustments in height of the gripper guide separately per gripper bar.

I claim:

1. Gripper guide for gripper weaving machines, comprising upper and lower drive wheels disposed at one side of first and second gripper bars, first and second guide strips extending along one side of each of the gripper bars, in a direction of motion of said gripper bars, and wherein at an opposite side of each of the gripper bars across from the drive wheels, first and second rollers are disposed such that the gripper bars are held between the rollers and the drive wheels, and parallel to the guide strips first and second slide strips are disposed such that the gripper bars can move to and fro between the guide strips and the slide strips while moving slidingly against the slide strips.

2. Gripper guide according to claim 1, wherein the slide strips extend in a drive direction such that each gripper bar is held between the respective slide strips and the drive wheels.

3. Gripper guide according to claim 1, further comprising means for adjustably fixing the slide strips opposite the guide strips for easily and rapidly removing the slide strips.

4. Gripper guide according to claim 1, further wherein the gripper guide comprises upper and lower horizontal bearing arms, the bearing arms being adjustably attached to a fixed part of a weaving machine, and on a front side of each of the bearing arms the first and second guide strips being adjustably fixed, each of the guide strips having L-shaped cross sections and being adjustable in height, and wherein at a front end of each of the guide strips and parallel thereto the slide strips are disposed at a same height, such that each of the L-shaped guide strips and the slide strips extending in front of the guide strips form upper and lower U-shaped guide channels, and means for adjustably fixing the slide strips to the respective bearing arms for easy and rapid removal of at least one of the slide strips to free each of the U-shaped channels along the front end.

5. Gripper guide according to claim 4, wherein each of the bearing arms is individually adjustably attached to a fixed part of a weaving machine, so that each bearing arm is adjustable in a warp direction, and each guide strip is individually adjustable in height, and means for adjustably fixing each slide strip to the respective bearing arms allowing for easy and rapid removal of each of the slide strips individually.

6. Gripper guide according to claim 4, wherein a first part of a first upper hinge is fixed to a top side of one end of the upper bearing arm and a second part of the first upper hinge is fixed to a front flank of the first slide strip, and at an opposite end of the upper bearing arm a first part of a second upper hinge is fixed to a housing, a second part of the second upper hinge being fixed to a rear flank of the first slide strip, each of the upper hinges being equipped with at least one upper buffer block integral with the hinged part being fixed to the upper bearing arm and the housing, such that the second parts of the upper hinges are in contact with the upper buffer block when the first slide strip is situated opposite the first guide strip in a position for guiding the first gripper bar and wherein the first parts of the upper hinges can be fixed to the upper buffer block by means of connecting means allowing the first slide strip to pivot upwards, relative to the upper bearing arm, and further wherein a first part of a first lower hinge is fixed to a bottom side of one end of the lower bearing arm and a second part of the first lower hinge is fixed to a front flank of the second slide strip, and a first part of a second lower hinge is fixed to another end of the lower bearing arm and a second part of the second lower hinge being fixed to a rear flank of the second slide strip, each of the lower hinges being equipped with at least one lower buffer block integral with the hinged part, being fixed to the lower bearing arm such that the second hinged parts of the lower hinges are in contact with the lower buffer block when the second slide strip is situated opposite the second guide strip in a position for guiding the second gripper bar, and wherein the second hinged parts of the lower hinges can be fixed to the lower buffer block by connection means allowing the second slide strip to pivot downward, relative to the lower bearing arm.

7. Gripper guide according to claim 1, wherein further each slide strip is individually connected to another part of the gripper guides respectively, by means of at least one hinge such that each slide strip can be easily and rapidly removed from or reset into a position along the gripper bars.

8. Gripper guides according to claim 1, wherein each of the slide strips is provided with connecting means having at least one adjusting screw for separately adjusting a horizontal distance between the respective L-shaped guide strips and the slide strips.

9. Gripper guide according to claim 1, at least one dry lubricating device is provided along a side of each of the slide strips for lubricating the gripper bars during the to and fro sliding movement.

10. Gripper guide according to claim 1, wherein a bearing arm is individually fixed to a wall of a part of a housing by means of a widened end of each bearing arm, said end being provided with at least one elongated aperture extending in a warp direction, connection means for inserting through each aperture into a bore in the wall of the part of the housing, so that the bearing arms are individually adjustable in the warp direction, and the first and the second L-shaped guide strips are fixed at a front side of each bearing arm with a horizontal part lying along a bottom side, and a vertical part lying against a front side of each of the bearing arms respectively, thus running together therewith along an entire length, along a side of the housing and ending just before a projection of the drive gear wheels, and the L-shaped guide strips are fixed to the bearing arms respectively such that said guide strips are individually adjustable in height by means of at least one vertical aperture provided in each of the bearing arms through which apertures the connection means project when inserted into the respective bearing arms.

11. Gripper guide according to claim 10, wherein a hinged part of each of an upper hinge and lower hinge is fixed to a front flank of the slide strips respectively, by means of screws inserted through elongated vertically extending apertures for adjusting a height of each of the slide strips.

12. Gripper guide according to claim 10, further comprising upper and lower short sections being adjustably fixed to the housing, each with L-shaped cross-sections corresponding to the L-shaped guide strips, said short sections being adjustable in height and in a warp direction, each short section having a horizontal arm provided with an elongated aperture extending in the warp direction, for fixing with a connection means, and both the short sections being fixed to upper and lower L-shaped fixing pieces, said fixing pieces being adjustable in height, one leg of each of the fixing pieces being fixed against the horizontal arms of the short sections respectively, and another angle-forming leg of each fixing piece is adjustably attached to a fixed part of the weaving machine by connection means inserted through elongated vertically extending apertures of each of the fixing pieces respectively.

13. Gripper guide according to claim 1, wherein in each slide strip at least one teflon stick is provided, said teflon stick projecting until it lies against the gripper bars, and means for adjusting and regulating the pressure applied on the gripper bars when the teflon stick pushes against the gripper bars.

14. Gripper guide according to claim 1, wherein a side of each of the slide strips facing the gripper bars is provided with an anti-friction surface coating.

15. Gripper guide according to claim 1, wherein a housing of the drive gear wheels is provided with at least one slit for fixing first and second suspension bars extending towards a fabric, and having adjustable means fixed to each suspension bar for guiding the gripper bars close to an edge of the fabric, said means being adjustable in height, in a weft direction and in a warp direction.

16. Gripper guide for double-gripper weaving machines, comprising double gripper guides for guiding double-gripper bars, first and second rollers disposed opposite each of two driving wheels placed one above another, such that the gripper bars are held between the rollers and the driving wheels, respectively, first and second slide strips being disposed opposite and parallel to each of two guide strips respectively, said guide strips extending above one another in such a way that the gripper bars can move to and fro between the guide strips and the slide strips, sliding with a side opposite to that of the drive wheel against the slide strips.

17. Gripper guide according to claim 16, characterized in that the sliding strips form one unit.

18. Gripper guide according to claim 16, wherein each of the guiding strips and the sliding strips form separately adjustable parts of the double gripper guide.

* * * * *